United States Patent [19]

Sasaki et al.

[11] Patent Number: 4,629,654

[45] Date of Patent: Dec. 16, 1986

[54] VINYLIDENE FLUORIDE RESIN MONOFILAMENT AND PROCESS FOR PRODUCING THE SAME

[75] Inventors: Tohru Sasaki; Hiroyuki Endoh, both of Iwaki; Seiichi Oohira, Kitaibaragi, all of Japan

[73] Assignee: Kureha Kagaku Kogyo Kabushiki Kaisha, Tokyo, Japan

[21] Appl. No.: 728,802

[22] Filed: Apr. 29, 1985

[30] Foreign Application Priority Data

Apr. 28, 1984 [JP] Japan ..... 59-86764

[51] Int. Cl.[4] ..... D02G 3/00

[52] U.S. Cl. ..... 428/373; 428/364; 428/375; 428/394

[58] Field of Search ..... 428/364, 374, 375, 373, 428/394; 43/44.98; 264/171, 210.7, 290.5, 210.8; 525/199

[56] References Cited

U.S. PATENT DOCUMENTS 3,376,370 4/1968 Koblitz et al. ..... 264/210.7
4,302,556 11/1981 Endo et al. ..... 525/199
4,521,483 6/1985 Sasaki et al. ..... 428/373

FOREIGN PATENT DOCUMENTS 59-144614 8/1984 Japan .

*Primary Examiner*—Lorraine T. Kendell
*Attorney, Agent, or Firm*—Wenderoth, Lind & Ponack

[57] ABSTRACT

A vinylidene fluoride resin monofilament excellent in tensile strength and knot strength is further improved in abrasion resistance by heat-treating the oriented monofilament for such a short time period as to relax the orientation of only the surface portion of the monofilament. The vinylidene fluoride resin monofilament improved in abrasion resistance is characterized by a lower birefringence at the surface relative to a high average birefringence in a section perpendicular to the axis thereof.

4 Claims, 1 Drawing Figure

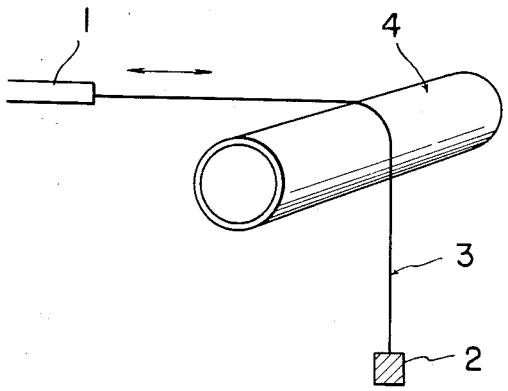
1
4
3
2

VINYLIDENE FLUORIDE RESIN MONOFILAMENT AND PROCESS FOR PRODUCING THE SAME

BACKGROUND OF THE INVENTION

The present invention relates to a mono-filament of a vinylidene fluoride resin (hereinafter sometimes expressed as "PVDF") having a remarkably improved abrasion resistance as well as satisfactory knot strength and tensile strength, and a process for producing the same.

A PVDF monofilament is excellent in knot strength and tensile strength in addition to weather resistance and is therefore suitable as a material for fishing lines, fishing nets, ropes, etc. In the use such as a fishing line, however, an abrasion resistance is important in addition to the above-mentioned physical properties, since it is rubbed with rockes, float rubber, etc.

As processes for producing PVDF monofilaments, several processes have been proposed, such as a process wherein stretching and heat fixation after melt spinning is effected at 80° C. or above by way of primary stretching, secondary stretching and the like as disclosed in Japanese Patent Publication No. 13399/1968; and a process wherein a primary stretching as mentioned above is carried out at a ratio between a primary point of flection and a secondary point of flection and the stretching is effected at a temperature of 150° to 170° C. as disclosed in Japanese Patent Publication No. 22574/1978.

The PVDF monofilaments obtained by the processes as mentioned above are highly oriented because of stretching and excellent in knot strength and tensile strength, whereas their abrasion resistances are not necessarily satisfactory.

SUMMARY OF THE INVENTION

A principal object of the present invention is to provide a vinylidene fluoride resin monofilament having a remarkably improved abrasion or wear resistance while retaining satisfactory knot strength and tensile strength.

Another object of the present invention is to provide a process for producing such a vinylidene fluoride resin monofilament.

According to our study, the stretching orientation adopted in the conventional processes as mentioned above is effective for improving the knot strength and tensile strength of a PVDF monofilament but is not necessary effective in respect of its abrasion resistance. On the contrary, when a PVDF monofilament is highly oriented, more noticeable fibrillation occurs at the surface layer rather than the fibrillation due to the presence of relatively large spherulite occurring in the interior of the filament which is gradually cooled relative to the surface layer, whereby a remarkable decrease in abrasion resistance is caused. Based on the above finding, we have further obtained a knowledge that an objective PVDF monofilament can be obtained by providing a filament structure having a smaller orientation at the surface layer than in the interior or core. We have also had a knowledge that a PVDF monofilament having such a structure can be obtained by heat treating the filament under tension in a fluid having a temperature above the melting point of the PVDF constituting the surface layer of the monofilament in such a short time as to relax the orientation of the surface part of the resin constituting the surface layer of the filament but not to relax a substantial part of the resin constituting the interior of the monofilament.

The vinylidene fluoride resin monofilament according to the present invention is based on the above knowledge and comprises a vinylidene fluoride resin at least in the surface layer thereof, said monofilament having a birefringence at the surface of $30\times10^{-3}$ or smaller and an average birefringence in a section perpendicular to the axis thereof of $30\times10^{-3}$ or larger.

Further, the process for producing a vinylidene fluoride resin monofilament comprising providing a starting monofilament at least the surface layer of which comprises an oriented vinylidene fluoride resin, and heat-treating under tension the monofilament in a fluid at a temperature exceeding at least one melting point of the vinylidene fluoride resin constituting the surface layer for such a short time period as to relax the orientation of the surface portion but not to relax the orientation of a substantial portion of the interior of the monofilament, thereby to produce a monofilament having a birefringence at the surface of below $30\times10^{-3}$ and an average birefringence in a section perpendicular to the axis thereof of $30\times10^{-3}$ or larger.

These and other objects, features and advantages of the present invention will become more apparent upon a consideration of the following description concluding with specific examples and comparative examples taken in conjunction with the accompanying drawing.

BRIEF DESCRIPTION OF THE DRAWING

The sole figure in the drawing illustrates an abrasion resistance test applied to monofilaments obtained in the Examples and Comparative Examples.

DETAILED DESCRIPTION OF THE INVENTION

At least the surface layer of the monofilament of the present invention comprises PVDF. Accordingly, the monofilament may entirely comprise PVDF or otherwise comprise a single or a plurality of internal layers of a thermoplastic resin other than PVDF such as a polyamide and a polyolefin. The monofilament preferably comprises PVDF entirely.

Even in the case where the monofilament entirely comprises PVDF, the monofilament can have the same degree of polymerization throughout the section or different degrees of polymerization between the surface layer and the interior. A structure comprising a surface layer of PVDF with a lower degree of polymerization is preferred in view of processibility. The PVDF, i.e., vinylidene fluoride resin, used in the present invention may be not only a vinylidne fluoride homopolymer but also a vinylidene fluoride copolymer comprising as the constituent units thereof 50 mol. % or more of vinylidene fluoride and one or more monomer copolymerizable therewith such as ethylene, vinyl fluoride, trifluoroethylene, tetrafluoroethylene, trifluorochloroethylene, hexafluoropropylene, etc. The PVDF constituting at least the surface layer may further be a composition of 60% by weight or more of such a vinylidene fluoride homopolymer or copolymer, and another resin which is compatible therewith or can be processed in mixture therewith such as poly(meth)acrylates, polycarbonates and polyesters, and various additives such as plasticizers, nucleating agents, dyes, and pigments.

A characteristic feature of the monofilament of the present invention is that the birefringence at the surface thereof is $30\times10^{-3}$ or less. From the viewpoint of abrasion resistance, it is preferred that the birefringence is as small as possible. The birefringence is preferably $25\times10^{-3}$ or less, more preferably $20\times10^{-3}$ or less.

Herein, the birefringence at the surface is obtained by measuring the refractive index $n_{\perp}$ in a direction perpendicular to the fiber axis and the refractive index $n_{\parallel}$ in a direction parallel with the fiber axis, both at the filament surface, at a measurement temperature of 20°-21° C. by the Bekke method and defined as the difference $\Delta n=n_{\parallel}-n_{\perp}$.

Another characteristic feature of the monofilament is that it has an average birefringence in a section perpendicular to the fiber axis of $30\times10^{-3}$ or larger. It is preferred from the viewpoints of knot strength and tensile strength of the filament that the average birefringence is as large as possible. The average birefringence is preferably $33\times10^{-3}$ or larger, more preferably $37\times10^{-3}$ or larger.

Herein, the average birefringence is defined as a value measured by the retardation method with the use of a polarizing microscope provided with a Berek's compensator and a sodium D-line as the light source under the conditions of 23° C. and 65 % humidity.

Next, the process according to the invention for producing such a PVDF monofilament will be explained hereinbelow.

In the present invention, a monofilament at least the surface layer of which comprises PVDF oriented in the direction of the fiber axis is first provided. It is preferred that the monofilament is oriented in the fiber axis direction as highly as possible since the effect of the present invention is more remarkably exhibited thereby. Thus, the monofilament to be used in the process of the present invention should preferably have an average birefringence in a section perpendicular to the fiber axis of $25\times10^{-3}$ or larger, more preferably $35\times10^{-3}$. Such oriented monofilaments can be obtained, for example, by the prior art processes explained hereinbefore, but other processes may also be applicable.

The process of the present invention, briefly described, comprises heat-treating under tension such a PVDF monofilament in a high temperature fluid for a short time to such an extent that the orientation of the surface part of the surface layer (if any, i.e., in a case where the monofilament comprises a laminar structure comprising a plurality of materials or different polymerization degrees of the same kind of PVDF, or otherwise the monofilament per se where it comprises a uniform material throughout the section) can be relaxed, but the orientations of the substantial or major part of the interior (if any, or otherwise the monofilament per se where it comprises a uniform material throughout the section) is not relaxed. If the relaxation of orientation proceeds up to the major part of the interior, the resultant monofilament cannot retain a satisfactory knot strength or tensile strength. For this reason, it is necessary that the orientation relaxation does not extend beyond the surface layer or a part of the interior at the most. However, where an optional resin (such as a polymer plasticizer) other than a principal resin such as PVDF, a polyamide or a polyolefin is present in the interior, it is not objectionable that the orientation of the optional resin is relaxed. Further, the surface layer is not required to be entirely orientation-relaxed but it is sufficient that at least the surface part of the surface layer is orientation-relaxed. The thickness of the surface part to be orientation-relaxed is ordinarily within the range of 1 to 10 microns, while it depends on the entire diameter of the monofilament. The orientation of the surface layer should preferably be relaxed to such an extent that the birefringence at the surface becomes $30\times10^{-3}$ or smaller, more preferably $25\times10^{-3}$ or smaller, particularly preferably $20\times10^{-3}$ or smaller.

More specifically, the starting monofilament oriented in the fiber direction as described above is treated or held for a short time in a fluid having such a high temperature as to relax the orientation of the surface part of the monofilament. The temperature of the fluid at this time is required to be higher than the melting temperature of the resin constituting the surface of the monofilament. The vinylidene fluoride resin constituting the surface can have a single melting temperature or otherwise a plurality of melting temperatures. In the latter case, the fluid temperature should exceed the lowest melting temperature and should preferably exceed the major melting point if it is different from the lowest melting temperature. Herein, the melting temperature refers to a temperature at which a peak of heat absorption due to melting is observed when a sample resin is subjected to temperature raising in nitrogen atmosphere in a differential scanning calorimeter, and the major melting point refers to a melting temperature giving the largest area of heat absorption based on a peak of heat absorption due to melting.

Where the fluid is a liquid, if the temperature thereof is too high, the orientation of the monofilament is entirely relaxed too much even in a short time. Accordingly, the fluid temperature should not exceed the major melting point by more than 30° C. Where the fluid is a gas which has a low thermal conductivity, a fluid temperature of the order of 200° to 500° C. is ordinarily used.

The time in which the monofilament is caused to contact the high temperature fluid is of the order of 0.1 to 8 seconds, preferably 0.2 to 8 seconds while it varies depending on the temperature and the kind of the fluid.

The monofilament is required to be held under tension in such a high temperature fluid. If not, the orientation of the monofilament is relaxed throughout the section so that the required knot strength or tensile strength cannot be satisfied.

In order to place the monofilament under tension, the monofilament is ordinarily stretched at a ratio of the order of 1.0 to 2.0 times. As a matter of course, the stretching ratio is increased as the monofilament is placed under tension at a higher temperature or for a longer time.

As the fluid for orientation relaxation to be used in the present invention, an inert liquid such as glycerin and a silicone oil, or an inert gas such as heated air, nitrogen, and steam can be used, while the fluids available for this purpose are not restricted thereto.

Through the process as described above, the monofilament according to the present invention is rendered into a diameter of generally 20 to 5000 microns.

As described in detail hereinabove, the present invention provides a PVDF monofilament which has a remarkably improved abrasion resistance while retaining satisfactory knot strength and tensile strength, and also a process for producing the same.

The thus obtained PVDF monofilament is, through utilization of its characteristic properties, suitably used as a fishing line or a material for filter, fishing net, rope, etc.

Hereinbelow, the present invention will be explained more specifically with reference to Examples and Comparative Examples.

EXAMPLE 1

A vinylidene fluoride homopolymer obtained by suspension polymerization and having an $\eta_{inh}$ of 1.32 dl/g as measured in a dimethylformamide solution at a concentration of 0.4 g/dl at 30° C. was melt-spun at 285° C. from an extruder of 32 mm in diameter into a non-stretched monofilament having a diameter of 380 microns and a birefringence $\Delta n$ of $3.2\times10^{-3}$. The filament was subjected to primary stretching at a ratio of 5.4 times in heated glycerin at 165° C. and then to secondary stretching at a ratio of 1.18 times in heated glycerin at 166° C., thereby to obtain a stretching filament having a diameter of 152 microns, an average birefringence of $36.5\times10^{-3}$, and a birefringence at the surface of $31\times10^{-3}$. The monofilament was further heat-treated in heated glycerin at 180° C. under such a tension as to cause 10 % of stretching in 2 seconds, whereby a filament of 146 microns in diameter was obtained.

The filament thus obtained showed an average birefringence of $38\times10^{-3}$, a birefringence at the surface of $20\times10^{-3}$, a tensile strength of 90 kg/mm$^2$, a knot strength of 68 kg/mm$^2$, and an abrasion resistance (number of abrasion up to the cutting) of more than 1000 times.

The tensile strength and the knot strength were measured as tensile tenacities at breakage obtained by pulling a sample filament of 300 mm in length at a rate of 300 mm/min at room temperature by means of a tension tester (Tensilon UTM III Model, produced by Toyo Baldwin K.K.). The knot strength was measured as a tensile tenacity when a knot was formed at the mid point of a sample filament.

The abration resistance was measured, as shown in the attached drawing by reciprocally moving a sample monofilament (3), to which a load of 35 kg/mm$^2$ of a load (2) was applied, on a round bar of 100 mm outer diameter covered with a cotton cloth (4) at a rate of 100 mm/sec by means of a Gakushin-type improved abrasion tester (produced by Tester Sangyo K.K.). The abrasion resistance was measured as the number of the reciprocal movement up to the cutting of the sample filament.

COMPARATIVE EXAMPLE 1

A PVDF monofilament subjected to only two steps of stretching as described in Example 1 but without the further heat treatment according to the present invention had an average birefringence of $36.5\times10^{-3}$ and a birefringence at the surface of $31\times10^{-3}$. The monofilament further showed a tensile strength of 85 kg/mm$^2$, a knot strength of 68 kg/mm$^2$ and an abrasion resistance of 150 times.

EXAMPLE 2

A concentric laminate filament comprising a core of a vinylidene fluoride homopolymer having an $\eta_{inh}$ of 1.32 dl/g and a sheath of a vinylidene fluoride homopolymer having an $\eta_{inh}$ of 1.10 dl/g, both obtained by suspension polymerization, in a core/sheath volume ratio of 80:20, was melt-spun at a temperature of 285° C. to form a nonstretched filament having an outer diameter of 380 microns and an average birefringence of $3.5\times10^{-3}$. Subsequently, the monofilament was stretched at a ratio of 5.4 times in heated glycerin at a temperature of 167° C. and then stretched at a ratio of 1.18 times in heated glycerin at 167° C., thereby to obtain a stretched filament having a diameter of 152 microns and an average birefringence of $37\times10^{-3}$. The monofilament was further heat-treated in heated glycerin at 180° C. under such a tension as to cause 10% of stretching in 2 seconds, whereby a filament of 146 microns in diameter was obtained.

The thus obtained monofilament showed an average birefringence of $39\times10^{-3}$, a birefringence at the surface of $18\times10^{-3}$, a tensile strength of 95 kg/mm$^2$, a knot strength of 72 kg/mm$^2$ and an abrasion resistance (number of abrasion up to the cutting) of more than 1000 times.

COMPARATIVE EXAMPLE 2

A laminate filament was obtained by repeating the procedure of Example 2 up to the ordinary two step stretching but without carrying out the further heat treatment. The filament thus obtained had an average birefringence of $37\times10^{-3}$ and a birefringence at the surface of $33\times10^{-3}$ and showed a tensile strength of 90 kg/mm$^2$, a knot strength of 72 kg/mm$^2$, and an abrasion resistance of 140 times.

EXAMPLES 3-6, COMPARATIVE EXAMPLES 3-8

The procedure of Example 1 or Example 2 was repeated with modifications shown in the following Table 1 with respect to conditions for the two steps of stretching and the heat treatment for orientation relaxation according to the present invention. The properties and evaluation of the monofilaments thus obtained are summarized in Table 2 together with those of the above examples.

TABLE 1

| | 1st stretching | | 2nd stretching | | Heat treatment (under tension) | | | |
|---|---|---|---|---|---|---|---|---|
| | Temp. (°C.) | Ratio (times) | Temp. (°C.) | Ratio (times) | Temp. (°C.) | Ratio (times) | Time (sec.) | Other conditions |
| Example 1 | 165 | 5.4 | 166 | 1.18 | 180 | 1.10 | 2 | Described in the text |
| Comparative Example 1 | " | " | " | " | | None | | Described in the text |
| Example 2 | " | " | 167 | " | 180 | 1.10 | 2 | Described in the text |
| Comparative Example 2 | " | " | " | " | | None | | Described in the text |
| Example 3 | " | " | 166 | 1.15 | 180 | 1.05 | 2 | The same as in Example 1 |
| Comparative Example 3 | " | " | " | " | | None | | The same as in Example 1 |
| Example 4 | " | " | 167 | " | 180 | 1.10 | 2.3 | The same as |

TABLE 1-continued

| | 1st stretching | | 2nd stretching | | Heat treatment (under tension) | | | |
|---|---|---|---|---|---|---|---|---|
| | Temp. (°C.) | Ratio (times) | Temp. (°C.) | Ratio (times) | Temp. (°C.) | Ratio (times) | Time (sec.) | Other conditions |
| | | | | | | | | in Example 2 |
| Example 5 | " | " | " | " | " | " | 4 | The same as in Example 2 |
| Example 6 | " | " | " | " | " | " | 6 | The same as in Example 2 |
| Comparative Example 4 | " | " | " | " | | None | | The same as in Example 2 |
| Comparative Example 5 | " | " | " | " | 174 | 1.05 | 4 | The same as in Example 2 |
| Comparative Example 6 | " | " | " | " | 174 | 1.10 | 4 | The same as in Example 2 |
| Comparative Example | " | " | " | " | 180 | 0.90 | 2 | The same as in Example 2 |
| Comparative Example 8 | " | " | " | " | 185 | 1.20 | 8.5 | The same as in Example 2 |

TABLE 2

| | Average birefringence through the section $\Delta n(\Delta n_T)$ ($\times 10^{-3}$) | Birefringence at surface $\Delta n(\Delta n_S)$ ($\times 10^{-3}$) | $\Delta n_S - \Delta n_T$ ($\times 10^{-3}$) | Evaluation |
|---|---|---|---|---|
| Example 1 | 38.0 | 20.0 | −18.0 | *1 |
| Comparative Example 1 | 36.5 | 31.0 | −5.5 | *2 |
| Example 2 | 39.0 | 18.0 | −21.0 | *1 |
| Comparative Example 2 | 37.0 | 33.0 | −4.0 | *2 |
| Example 3 | 37.0 | 19.9 | −17.1 | *1 |
| Comparative Example 3 | 37.8 | 31.2 | −6.6 | *2 |
| Example 4 | 36.7 | 18.5 | −18.2 | *1 |
| Example 5 | 35.6 | 11.8 | −23.8 | *1 |
| Example 6 | 35.6 | 11.4 | −24.2 | *1 |
| Comparative Example 4 | 36.0 | 30.2 | −5.8 | *2 |
| Comparative Example 5 | 39.2 | 31.7 | −7.5 | *2 |
| Comparative Example 6 | 39.4 | 30.9 | −8.5 | *2 |
| Comparative Example 7 | — | — | — | *3 |
| Comparative Example 8 | 20.0 | 8.3 | −11.7 | *4 |

Evaluation
*1: Good abrasion resistance
*2: Poor abrasion resistance
*3: Cut due to melting in a heating bath
*4: Poor tensile strength

What is claimed is:

1. A vinylidene fluoride resin monofilament comprising a vinylidene fluoride resin at least in the surface layer thereof, said monofilament having a birefringence at the surface of $25\times10^{-3}$ or less and an average birefringence in a section perpendicular to the axis thereof of $33\times10^{-3}$ or greater.

2. The monofilament according to claim 1, which entirely comprises a vinylidene fluoride resin throughout the section perpendicular to the axis thereof.

3. The monofilament according to claim 2, which comprises a laminate structure having a surface layer comprising a vinylidene fluoride resin of a lower molecular weight and an interior covered within the surface layer comprising a vinylidene fluoride resin of a higher molecular weight.

4. The monofilament according to claim 1, which comprises a laminate structure having a surface layer comprising a vinylidene fluoride resin and an interior covered within the surface layer comprising a thermoplastic resin other than the vinylidene fluoride resin.

* * * * *